US006686815B1

(12) United States Patent
Mirshekarl-Syahkal et al.

(10) Patent No.: US 6,686,815 B1
(45) Date of Patent: Feb. 3, 2004

(54) MICROWAVE FILTER

(75) Inventors: Dariush Mirshekarl-Syahkal, Colchester (GB); Joseph Chuma, Garborone Botswana (GB)

(73) Assignee: Nokia Corporation, Espoo (FI)

( * ) Notice: Subject to any disclaimer, the term of this patent is extended or adjusted under 35 U.S.C. 154(b) by 49 days.

(21) Appl. No.: 10/049,149

(22) PCT Filed: Jul. 26, 2000

(86) PCT No.: PCT/EP00/07197

§ 371 (c)(1),
(2), (4) Date: Jun. 19, 2002

(87) PCT Pub. No.: WO01/13460

PCT Pub. Date: Feb. 22, 2001

(30) Foreign Application Priority Data

Aug. 11, 1999 (GB) ..... 9918958

(51) Int. Cl.[7] ..... H01P 1/20
(52) U.S. Cl. ..... 333/202; 333/212
(58) Field of Search ..... 333/202, 212, 333/219, 230, 208, 209

(56) References Cited

U.S. PATENT DOCUMENTS

| | | | | |
|---|---|---|---|---|
| 4,179,673 A | | 12/1979 | Nishikawa et al. | |
| 4,283,697 A | | 8/1981 | Masuda et al. | |
| 4,287,494 A | | 9/1981 | Hashimoto et al. | |
| 4,652,843 A | * | 3/1987 | Tang et al. | 333/212 |
| 4,673,902 A | | 6/1987 | Takeda et al. | |
| 5,841,330 A | * | 11/1998 | Wenzel et al. | 333/202 |
| 5,867,076 A | | 2/1999 | Tada et al. | |

FOREIGN PATENT DOCUMENTS

| | | |
|---|---|---|
| DE | 1070252 | 12/1959 |
| EP | 369757 | 5/1990 |
| WO | 9930383 | 6/1999 |

OTHER PUBLICATIONS

Patent Abstracts of Japan, vol. 5, No. 11 (E–42) '683, Jan. 23, 1981 & JP 55 141802 A (ALPS Denki K.K.), Nov. 6, 1980 Abstract.

Patent Abstracts of Japan, vol. 6, No. 91 (E–109) '969, May 28, 1982 & JP 57 205701 A (Tokyo Denki Kagaku Kogyo K.K), Feb. 10, 1982 Abstract.

Hui–Wen Yao et al: "Full Wave Modeling of Conducting Posts in Rectangular Waveguides and its Applications to Slot Coupled Combline Filters", IEEE Transactions on Microwave Theory, US, IEEE Inc., New York, vol. 43, No. 12, Part 2, Dec. 1, 1995, pp. 2824–2830, XP000549432 ISSN: 0018–9480 p. 2827, right hand column, line 11–14; Figure 1.

* cited by examiner

*Primary Examiner*—Brian Young
*Assistant Examiner*—Joseph Lauture
(74) *Attorney, Agent, or Firm*—Antonelli, Terry, Stout & Kraus, LLP

(57) ABSTRACT

A filter element comprising a conductive element mounted in a conductive housing, the conductive element and conductive housing arranged such that the conductive element is electrically coupled to the conductive housing at one end of the element and capacitively coupled to the conductive housing at the opposite end of the element with a solid dielectric element disposed around a length of the conductive element.

40 Claims, 4 Drawing Sheets

MICROWAVE FILTER

BACKGROUND OF THE INVENTION

1. Field of the Invention

This invention relates to a filter, and in particular a combline filter.

2. Description of the Prior Art

Within the communications industry, and in particular base station design, a filter that has become increasingly popular is the combline filter. The combline filter comprises a series of filter elements where each filter element has a resonator post. The coupling between different resonator posts is achieved by way of fringing fields using air as a dielectric, as described in 'Combline band-pass filters of narrow or moderate bandwidth', The Microwave Journal, Vol 6, pg 82–91, Aug. 1963. Some of the characteristics of the combline filter that have resulted in the increased popularity of the filter are low insertion losses, high Q, good out of band performance and the filters are relatively cheap to manufacture.

These filters, however, are relatively large making them unsuitable for the miniaturization of base stations for office use. Further, the required distance between two resonator posts can inhibit the required electrical coupling between adjacent resonator posts. This has resulted in the use of extended probes to provide the electrical coupling.

Ceramic filters having the required pass bands for mobile communication offer a reduction in filter size compared with a combline filter but suffer from poor out of band performance. Further, with ceramic filters it can be difficult to obtain the required electrical and magnetic coupling between different resonator elements.

In accordance with a first aspect of the present invention there is provided a filter element comprising a conductive element mounted in a conductive housing, the conductive element and conductive housing arranged such that the conductive element is electrically coupled to the conductive housing at one end of the element and capacitively coupled to the conductive housing at the opposite end of the element with a solid dielectric element disposed around a length of the conductive element.

This provides the advantage of smaller filters than equivalent conventional combline filters while still offering low insertion losses, high Q and good out of band performance.

Suitably the solid dielectric element is a ceramic element.

Preferably the solid dielectric element is in direct contact with the conductive element.

Most preferably the conductive element is plated onto the solid dielectric element.

Having the conductive element in direct contact with the solid dielectric element allows heat generated in the solid dielectric element to be dissipated through the conductive element. This provides good heat dissipation capability.

Preferably the solid dielectric element extends for substantially the whole length of the conductive element.

Preferably the capacitive coupling between the end of the conductive element and the conductive housing is adjustable.

In accordance with a second aspect of the present invention there is provided a filter element comprising an inner conductor having an electrical length less than a quarter wavelength of the resonant frequency of the filter and an outer conductor arranged as a transmission line; a solid dielectric element disposed between the inner conductor and outer conductor; wherein one end of the inner conductor is electrically coupled to the outer conductor, the opposite end of the inner conductor being capacitively coupled to the outer conductor.

BRIEF DESCRIPTION OF THE DRAWINGS

The invention will now be described, by way of one example only, with reference to the accompanying drawings, in which:

FIG. 1*b* shows a plan view of a filter element according to an embodiment of the present invention;

Figure 1A:
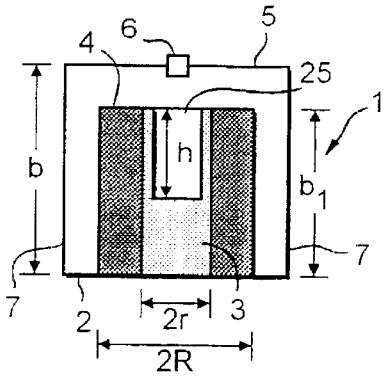
FIGS. 1*a* and 1*b* show a cross sectional view and plan view respectively of a filter element 1. To obtain the required bandwidth for a filter, a filter would typically comprise a plurality of filter elements 1. However, a filter could comprise a single filter element 1.

Filter element 1 has a metal housing 2 that is electrically coupled to conductive element 3, otherwise known as a resonator post. The metal housing 2 and conductive element 3 are arranged as a transverse electromagnetic (TEM) transmission line. A solid dielectric ring 4, which in this embodiment is selected to be ceramic having a dielectric constant of 37, is placed around the resonator post, thereby loading the post. This has the effect of changing the electrical length of the resonator post 3, thereby allowing the physical length of the resonator post 3 to be decreased. The dimensions of the ceramic ring 4 are selected so that when the ceramic ring 4 is placed around the resonator post 3 the ceramic ring 4 is in direct contact with the post 3. This allows heat generated in the ceramic ring 4 to be dissipated through the resonator post 3. Alternatively, however, the conductive element 3 can be plated onto the inside surface of the ceramic ring 4.

An air gap exists between the top of the resonator post 3 and the metal housing top 5, thereby forming a capacitive coupling between the top of the resonator post 3 and the housing. Consequently, because of the capacative affect between the top of the resonator post 3 and the conductive housing 2, the electrical length of the resonator post will be less than a quarter wave length (i.e. less than 90°) of the required filter element 1 resonant wavelength. Typically the electrical length of the resonator post 3 will be between 45° and 85° (i.e. between approximately one eighth and fifteen sixty-fourths wavelength of the resonant frequency of the filter element).

If fine tuning of the filter element 1 resonance is required, a tuning screw 6 is located on the conductive housing top 5, situated above the resonator post 3. The tuning screw 6 can be used to vary the filter element 1 capacitance and thereby the resonant frequency of the filter element 1 for fine tuning of the filter element 1, should this be necessary.

Figure 1B:
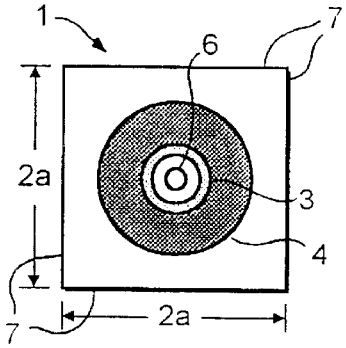

The dimensions of the filter element 1, as shown in FIGS. 1*a* and 1*b*, provide a resonant frequency of 1.765 GHz. The dimensions of the filter element 1 are:

| | |
|---|---|
| Conductive housing 2 | (width) 2a - 20 mm<br>(height) b - 23 mm |
| Resonator post 3 | (height) b1 - 20 mm<br>(diameter) 2r - 12.7 mm |
| Resonator post cavity 25 | (height) h - 18 mm<br>(diameter) 2d - 8 mm |
| Ceramic ring 4 | (height) b1 - 20 mm<br>(outer diameter) 2R - 18 mm<br>(inner diameter) 2r - 12.7 mm |

The Q of the filter element 1 is determined, in part, by the diameter of the resonator post 3. Therefore, to maintain a high Q, the diameter of the resonator post 3 has been selected to be the same as an equivalent conventional combline filter. Increasing the diameter of the ceramic ring 4 results in a reduction in the resonant frequency of the filter element. Therefore, the minimum resonant frequency of the filter is achieved when the inner diameter of the ceramic ring 4 is touching the resonator post 3 and the outer diameter of the ceramic ring 4 is touching the metal housing walls 7.

Placing ceramic along the length of the resonator post 3, between the resonator post 3 and the metal housing walls 7, results in the loading of the resonator post 3. The effect of loading the resonator post 3 with a high dielectric material, such as ceramic, is to vary the resonant frequency of the filter element 1. Therefore, using ceramic to load the resonator post means that the distance between the resonator post 3 and the metal housing walls 7 can be reduced compared with an equivalent conventional combline filter element. Also, as stated above, the loading of the resonator post 3 with ceramic changes the electrical length of the resonator post 3, thereby allowing the physical length to be decreased. Consequently, the overall size of the filter is about a quarter of the size of the equivalent conventional filter. If the height of the ceramic ring 4 is reduced in relation to the resonator post 3 this will have the effect of increasing the wavelength and correspondingly, for the same resonant frequency, result in a larger filter element.

Figure 2A:
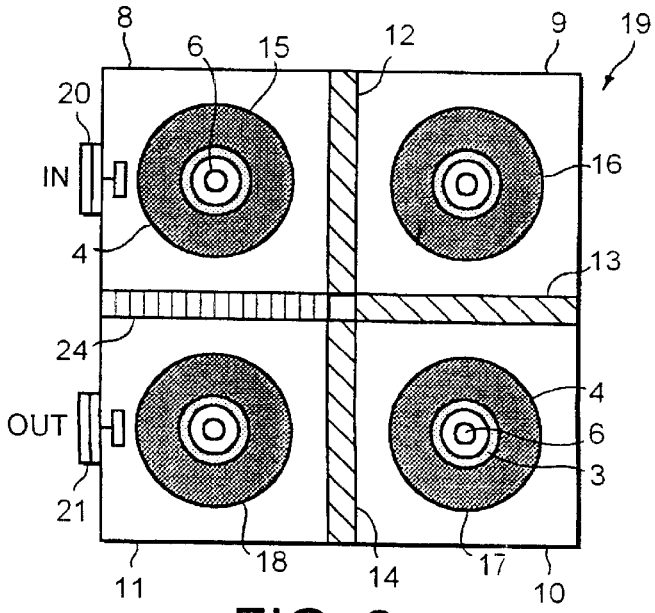
FIG. 2*a* shows a plan view of a filter according to an embodiment of the present invention.

FIG. 2*a* shows a plan view of a filter 19 comprising four filter elements 8, 9, 10, 11, each element having the same dimensions as for filter element 1. Filter 19 is arranged as a fourth-order elliptic function filter. Common metal housing walls 12, 13, 14 exist between resonator elements 15 and 16, 16 and 17, 17 and 18 respectively. Each resonator element 15, 16, 17, 18 comprises a resonator post 3 loaded with a ceramic ring 4.

Filter 19 has an input 20 for connection to a signal source (not shown) and an output 21 for connection to a receiver (not shown).

To realize the filter 19, which is an elliptic function filter, magnetic couplings (i.e. positive couplings) are required between resonator elements 15 and 16, 16 and 17, 17 and 18 and electric coupling is required between resonator elements 15 and 18.

The use of negative coupling between resonator elements 15 and 18 increases the selectivity of the filter. Preferably, for negative coupling the electrical length of the resonator elements 15, 18 is 80° of the required resonant frequency wavelength. By loading the resonator posts in filter elements 8, 9, 10, 11 with ceramic the physical length of the corresponding resonator elements are approximately equal to a 50° length of an equivalent conventional combline filter.

The coupling between resonator elements can be calculated using the matrix rotation technique as described in 'New type of waveguide bandpass filters for satellite transponders', COMSAT Technical Review, Vol 1, No. 1, pg 21–43, 1971.

Figure 2B:
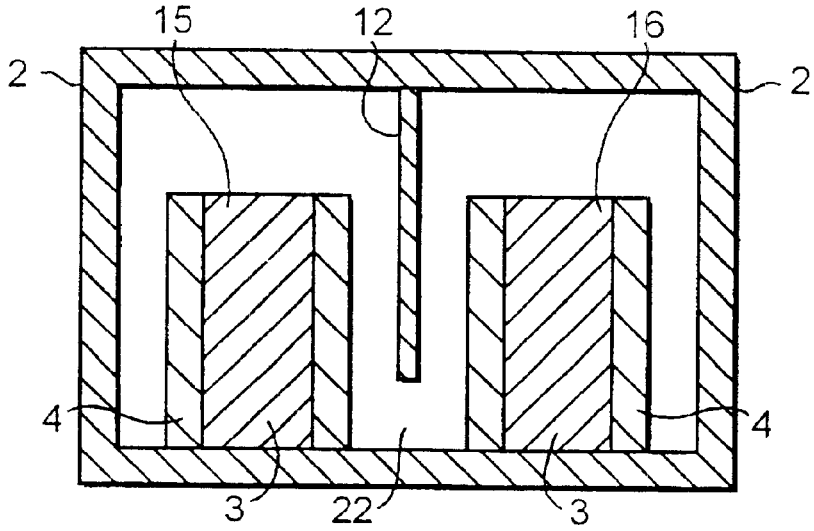
FIG. 2*b* shows a cross-sectional view of two coupled filter elements according to an embodiment of the present invention with a bottom opening between conductive elements.
Figure 2C:
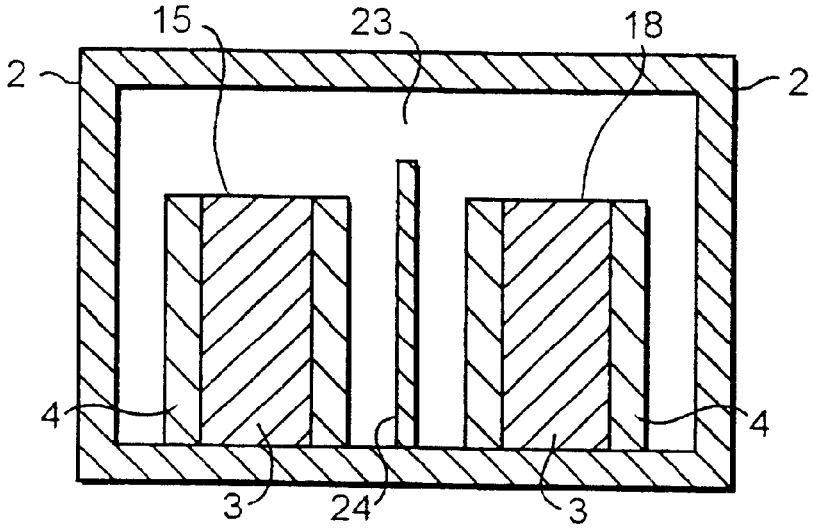
FIG. 2*c* shows a cross-sectional view of two coupled filter elements according to an embodiment of the present invention with a top opening between conductive elements.

As shown in FIG. 2*b*, the positive couplings are achieved using apertures 22 at the bottom of the common walls 12, 13, 14 between the respective resonator elements 15, 16, 17, 18. The negative coupling has been achieved using an aperture 23 at the top of the common wall 24 between resonators elements 15, 18, as can be seen in FIG. 2*c*.

The height of each aperture is determined from coupling data produced by computing the even and odd mode resonant frequencies of two coupled identical resonators as described in 'Effects of tuning structures on combline filters', 26$^{th}$EuMC Digest, pg 427–429, September 1996.

The use of apertures to realize negative coupling allows the size of the aperture to be calculated theoretically, thereby requiring virtually no adjustment to the coupling once the filter has been manufactured.

To simplify the manufacturing process, in this embodiment the positive and negative coupling apertures extend across the whole width of the common wall between two coupled cavities.

Figure 3:
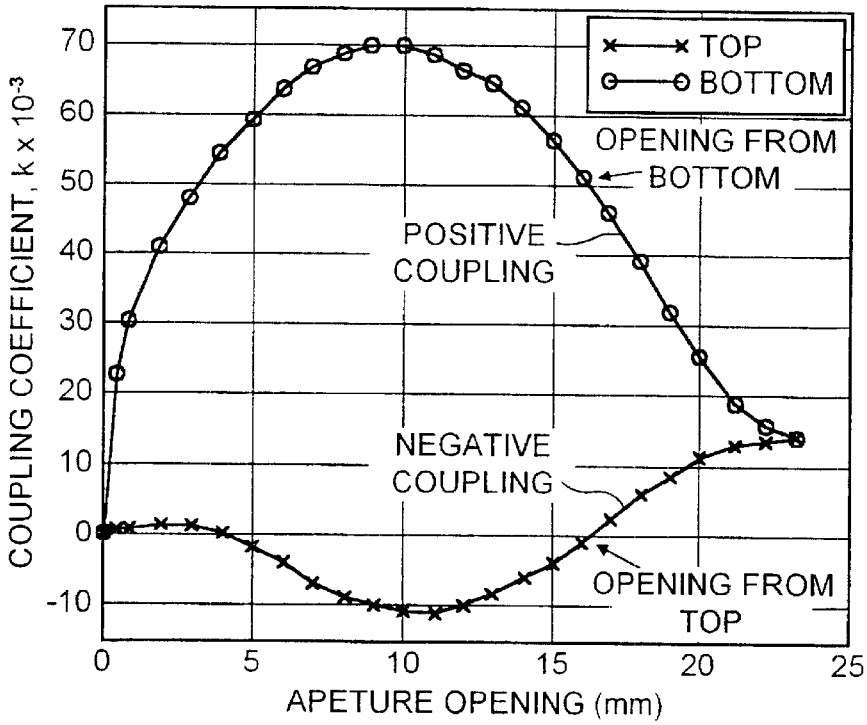
FIG. 3 shows the coupling coefficients between two filter elements having an opening between the elements.

FIG. 3 shows the coupling coefficients between resonator elements having an aperture between the resonator posts when the common wall is 1 mm thick. It will be appreciated by a person skilled in the art that the negative coupling aperture could be located at the bottom of the common wall and the positive coupling apertures could be located at the top of the common wall.

The filter dimensions are selected dependent upon the frequency of the signal to be received or transmitted. With the appropriate negative and positive couplings the filter as shown in FIGS. 2*a, b, c* will have a center frequency at 1.747 GHz with a bandwidth of 75 MHz.

Figure 4:
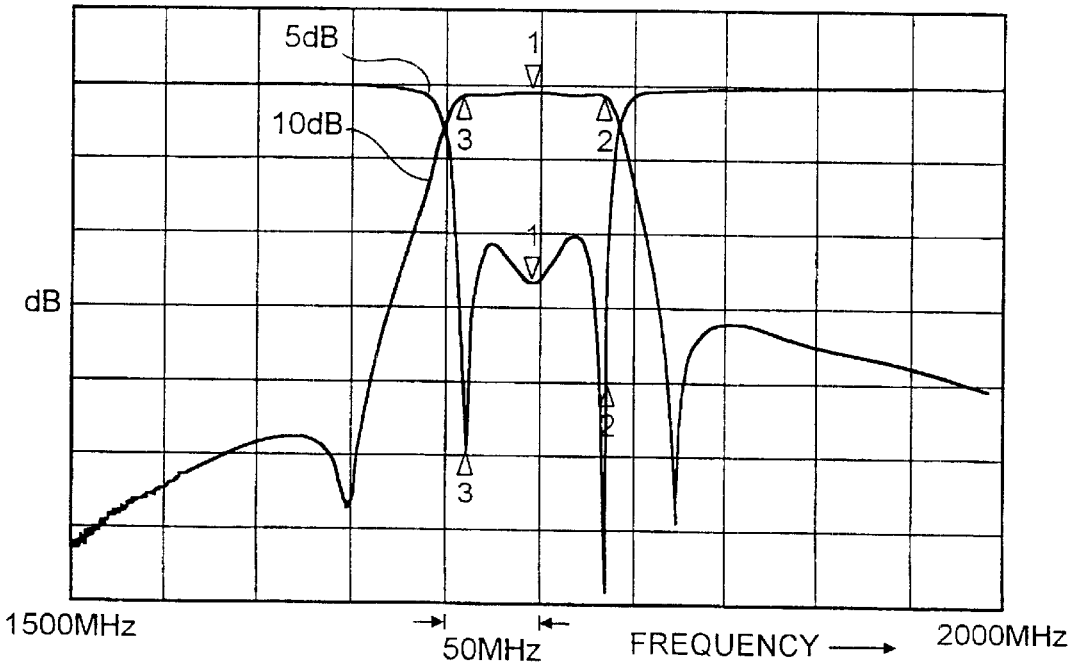
FIG. 4 shows the frequency response of a filter according to an embodiment of the present invention.

FIG. 4 shows the measured frequency response of a filter according to FIGS. 2*a, b, c* when made from aluminium.

Figure 5:
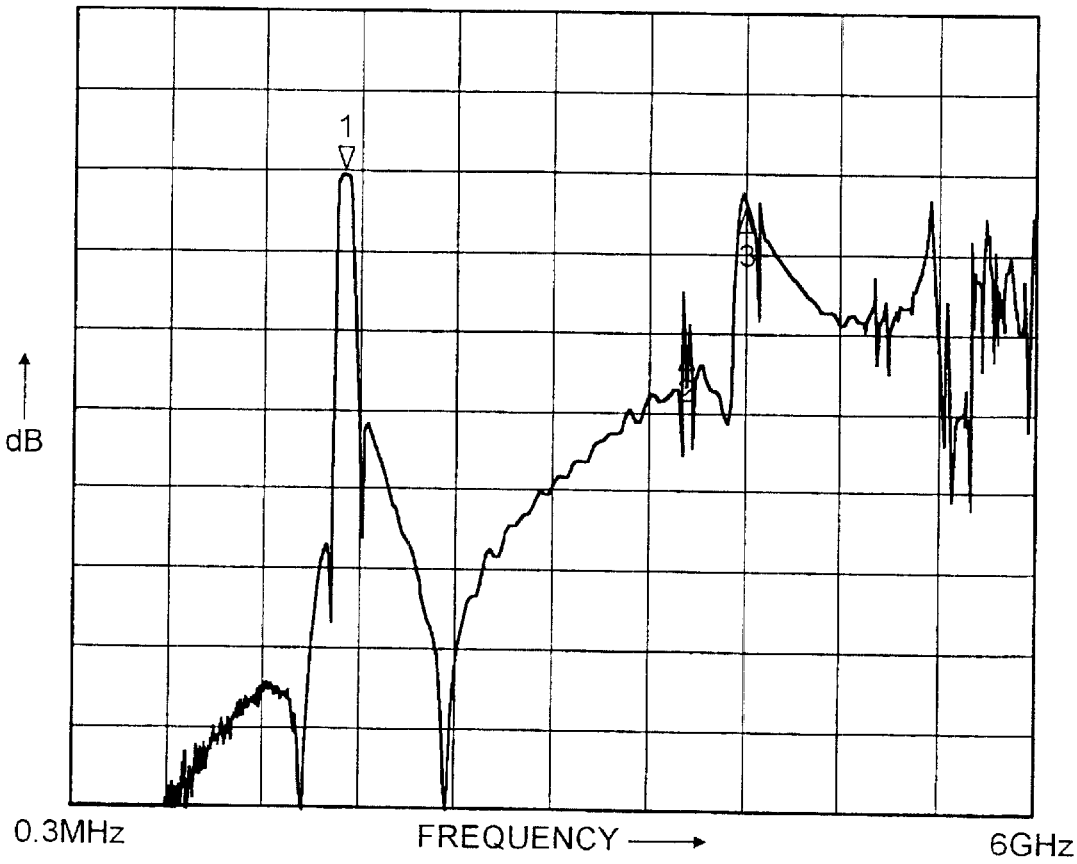
FIG. 5 shows the wideband response of a filter according to an embodiment of the present invention.

FIG. 5 shows the measured band response of the filter indicating a good out-of-band performance.

The insertion loss of filter, as shown in FIGS. 5, is about 0.7 dB at the center frequency for the fourth-order filter. This, however, can be improved, if the inner surface of the housing 2 and the outer surface of the post 3 are silver plated.

The present invention may include any novel feature or combination of features disclosed herein either explicitly or implicitly or any generalization thereof irrespective of whether or not it relates to the presently claimed invention or mitigates any or all of the problems addressed. In view of the foregoing description it will be evident to a person skilled in the art that various modifications may be made within the scope of the invention. The applicant hereby gives notice that new claims may be formulated to such features during prosecution of this application or of any such further application derived therefrom.

What is claimed is:

1. A filter comprising:

a plurality of adjacent filter elements providing an elliptic function filter, wherein the filter elements comprise a conductive element mounted in a conductive housing, the conductive element and conductive housing with the conductive element being electrically coupled to the conductive housing at one end of the element and capacitively coupled to the conductive housing at an opposite end of the element; and wherein a solid dielectric element is disposed around a length of conductive elements of two adjacent filter elements between which negative coupling is to occur and an opening providing electric coupling between the two adjacent filter elements.

2. A filter according to claim 1, wherein:

the solid dielectric element is a ceramic element.

3. A filter according to claim 2, wherein:

the conductive element has an electrical length less than a quarter wave length of the resonant frequency of the filter.

4. A filter according to claim 2, wherein:

the solid dielectric element is in direct contact with the conductive element.

5. A filter according to claim 2, wherein:

the conductive element is plated onto the solid dielectric element.

6. A filter according to claim 2, wherein:

the electrical length of the conductive element is between one eighth and fifteen sixty-fourths wavelength of a resonant frequency of the filter element.

7. A filter element according to claim 2, wherein:

the solid dielectric element extends for substantially a whole length of the conductive element.

8. A filter element according to claim 2, wherein:

the capacitive coupling between the end of the conductive element and the conductive housing is adjustable.

9. A filter according to claim 2, wherein:

the conductive housings of two adjacent filter elements have an opening providing magnetic coupling between the two filter elements.

10. A filter according to claim 1, wherein:

the conductive element has an electrical length less than a quarter wave length of a resonant frequency of the filter.

11. A filter according to claim 10, wherein:

the solid dielectric element is in direct contact with the conductive element.

12. A filter according to claim 10, wherein:

the conductive element is plated onto the solid dielectric element.

13. A filter according to claim 10, wherein:

the electrical length of the conductive element is between one eighth and fifteen sixty-fourths wavelength of a resonant frequency of the filter element.

14. A filter element according to claim 10, wherein:

the solid dielectric element extends for substantially a whole length of the conductive element.

15. A filter element according to claim 10, wherein:

the capacitive coupling between the end of the conductive element and the conductive housing is adjustable.

16. A filter according to claim 10, wherein:

the conductive housings of two adjacent filter elements have an opening providing magnetic coupling between the two filter elements.

17. A filter according to claim 1, wherein:

the solid dielectric element is in direct contact with the conductive element.

18. A filter according to claim 17, wherein:

the conductive element is plated onto the solid dielectric element.

19. A filter according to claim 17, wherein:

the electrical length of the conductive element is between one eighth and fifteen sixty-fourths wavelength of a resonant frequency of the filter element.

20. A filter element according to claim 17, wherein:

the solid dielectric element extends for substantially a whole length of the conductive element.

21. A filter according to claim 17, wherein:

the capacitive coupling between the end of the conductive element and the conductive housing is adjustable.

22. A filter according to claim 17, wherein:

the conductive housings of two adjacent filter elements have an opening providing magnetic coupling between the two filter elements.

23. A filter according to claim 1, wherein:

the conductive element is plated onto the solid dielectric element.

24. A filter according to claim 23, wherein:

the electrical length of the conductive element is between one eighth and fifteen sixty-fourths wavelength of a resonant frequency of the filter element.

25. A filter element according to claim 23, wherein:

the solid dielectric element extends for substantially a whole length of the conductive element.

26. A filter according to claim 23, wherein:

the capacitive coupling between the end of the conductive element and the conductive housing is adjustable.

27. A filter according to claim 23, wherein:

the conductive housings of two adjacent filter elements have an opening providing magnetic coupling between the two filter elements.

28. A filter according to claim 1, wherein:

the electrical length of the conductive element is between one eighth and fifteen sixty-fourths wavelength of a resonant frequency of the filter element.

29. A filter according to claim 28, wherein:

the solid dielectric element extends for substantially a whole length of the conductive element.

30. A filter according to claim 29, wherein:

the capacitive coupling between the end of the conductive element and the conductive housing is adjustable.

31. A filter according to claim 29, wherein:

the conductive housings of two adjacent filter elements have an opening providing magnetic coupling between the two filter elements.

32. A filter according to claim 28, wherein:

the capacitive coupling between the end of the conductive element and the conductive housing is adjustable.

33. A filter according to claim 32, wherein:

the conductive housings of two adjacent filter elements have an opening providing magnetic coupling between the two filter elements.

34. A filter according to claim 28, wherein:

the conductive housings of two adjacent filter elements have an opening providing magnetic coupling between the two filter elements.

35. A filter according to claim 28, wherein:

the solid dielectric element extends for substantially a whole length of the conductive element.

36. A filter according to claim 28, wherein:

the capacitive coupling between the end of the conductive element and the conductive housing is adjustable.

37. A filter according to claim 28, wherein:

the conductive housings of two adjacent filter elements have an opening providing magnetic coupling between the two filter elements.

38. A receiver having a filter according to claim 1.

39. A transmitter having a filter according to claim 1.

40. A base station having a filter according to claim 1.

* * * * *